US011821684B2

(12) United States Patent
Crondahl

(10) Patent No.: US 11,821,684 B2
(45) Date of Patent: Nov. 21, 2023

(54) APPARATUS AND METHODS FOR DRYING MATERIALS

(71) Applicant: Westmill Industries Ltd., Abbotsford (CA)

(72) Inventor: Michael Crondahl, Mission (CA)

(73) Assignee: Westmill Industries Ltd., Abbotsford (CA)

( * ) Notice: Subject to any disclaimer, the term of this patent is extended or adjusted under 35 U.S.C. 154(b) by 0 days.

(21) Appl. No.: 18/058,343

(22) Filed: Nov. 23, 2022

(65) Prior Publication Data

US 2023/0092366 A1 Mar. 23, 2023

Related U.S. Application Data

(63) Continuation of application No. 17/074,395, filed on Oct. 19, 2020, now Pat. No. 11,536,513.

(60) Provisional application No. 62/926,285, filed on Oct. 25, 2019.

(51) Int. Cl.

| | |
|---|---|
| ***F26B 21/12*** | (2006.01) |
| ***F26B 21/00*** | (2006.01) |
| ***F26B 21/10*** | (2006.01) |
| ***F26B 25/00*** | (2006.01) |
| ***F26B 15/12*** | (2006.01) |
| ***F26B 3/04*** | (2006.01) |

(52) U.S. Cl.

CPC ..... *F26B 21/12* (2013.01); *F26B 21/005* (2013.01); *F26B 21/10* (2013.01); *F26B 25/008* (2013.01); *F26B 3/04* (2013.01); *F26B 15/12* (2013.01); *F26B 2210/14* (2013.01)

(58) Field of Classification Search

CPC ..... F26B 21/12; F26B 21/005; F26B 21/10; F26B 25/008; F26B 3/04; F26B 15/12; F26B 2210/14

USPC ..... 34/487

See application file for complete search history.

(56) References Cited

U.S. PATENT DOCUMENTS

| | | | | |
|---|---|---|---|---|
| 3,259,995 | A * | 7/1966 | Powischill | F26B 21/10 392/307 |
| 3,263,337 | A * | 8/1966 | Sjogren | F26B 15/205 159/7 |
| 3,757,428 | A | 9/1973 | Runciman | |

(Continued)

FOREIGN PATENT DOCUMENTS

| | | | |
|---|---|---|---|
| CA | 2607017 | C | 1/2015 |
| EP | 2535156 | B1 | 10/2014 |
| KR | 20140059171 | A | 5/2014 |

*Primary Examiner* — Stephen M Gravini

(74) *Attorney, Agent, or Firm* — Oyen Wiggs Green & Mutala LLP

(57) ABSTRACT

A method for drying materials is disclosed. The method comprises introducing a material into a dryer chamber, creating steam from vaporizing moisture in the material by maintaining the chamber at a temperature, conditioning the material using the steam created from vaporing moisture in the material by conveying the material along a length of the chamber from an inlet end to an outlet end, exhausting steam near the inlet end of the chamber, exhausting steam near a dry-end exit end of the chamber, controlling a migration of moisture between the inlet and outlet ends by adjusting an exhaust flow rate near the inlet end of the chamber and/or an exhaust flow rate near the dry-end exit end of the chamber, and withdrawing the material from the chamber.

16 Claims, 6 Drawing Sheets

(56) References Cited

U.S. PATENT DOCUMENTS

| | | | | |
|---|---|---|---|---|
| 4,026,037 | A | 5/1977 | Buchholz | |
| 4,106,215 | A | 8/1978 | Rosen | |
| 4,127,946 | A | 12/1978 | Buchholz | |
| 4,197,657 | A | 4/1980 | Leino et al. | |
| 6,477,807 | B1 | 11/2002 | Crondahl et al. | |
| 6,725,566 | B1 | 4/2004 | Skrotsky et al. | |
| 8,046,932 | B2 | 11/2011 | Wolowiecki | |
| 8,196,310 | B2 | 6/2012 | McMahon et al. | |
| 8,291,611 | B2 | 10/2012 | Eriksen | |
| 8,381,414 | B2 | 2/2013 | Wolowiecki | |
| 8,667,703 | B2 | 3/2014 | McMahon et al. | |
| 9,200,834 | B1 * | 12/2015 | Ball, Jr. | F26B 3/06 |
| 9,228,780 | B2 | 1/2016 | McMahon et al. | |
| 9,797,655 | B2 | 10/2017 | McMahon et al. | |
| 9,848,629 | B1 * | 12/2017 | Strahm | F26B 21/12 |
| 10,006,712 | B2 | 6/2018 | Crondahl et al. | |
| 10,317,138 | B2 | 6/2019 | Crondahl et al. | |
| 11,193,211 | B2 | 12/2021 | Crondahl et al. | |
| 11,536,513 | B2 * | 12/2022 | Crondahl | F26B 21/005 |
| 2014/0124354 | A1 | 5/2014 | Pagnozzi | |
| 2021/0078199 | A1 | 3/2021 | Crondahl et al. | |
| 2021/0123674 | A1 | 4/2021 | Crondahl | |
| 2021/0154884 | A1 | 5/2021 | Zhou et al. | |
| 2023/0092366 | A1 * | 3/2023 | Crondahl | F26B 21/005 |

* cited by examiner

APPARATUS AND METHODS FOR DRYING MATERIALS

TECHNICAL FIELD

Some embodiments of the present invention relate to an apparatus and method for drying materials. Some embodiments of the present invention relate to an apparatus and method for drying materials in a high humidity environment.

BACKGROUND

Proper humidity control within a drying chamber is critical. Improper humidity control during the drying process negatively affects the quality of the material. Conventional wood veneer dryers, for example, fail to provide proper control of the moisture level within the drying chamber. In particular, the humidity level within conventional chambers is not properly distributed throughout the chamber. The majority of the moisture content (e.g., from evaporation of the free water found outside of the cell walls of wood veneers) remains in the green-end of the dryer. The remaining moisture in the veneer (e.g., the bound water found within the cell walls of wood veneers) continues to evaporate as the material to be dried is conveyed along the length of the dryer towards the dry-end. By the time the veneer reaches the dry-end, very little moisture is left to evaporate from the material. This results in a very hot and dry environment within that end. Such environment damages wood veneers.

There is a general desire for an apparatus and method for drying materials with improved humidity control during the drying process. Improved humidity control during the drying process results in properly dried materials. Materials that are properly dried means that the materials are neither over-dried nor under-dried but dried to a target moisture level. There is thus a general desire for an apparatus and method that is capable of drying wood veneers to a target moisture level, for example, at about 8% of moisture remaining after drying.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides an apparatus for drying materials. The materials to be dried may be wood veneer. The apparatus has a chamber with a green-end extending to a dry-end between an inlet end and a dry-end exit end. Inlet end seal section and outlet end seal sections are connected to the inlet end and dry-end exit end of the chamber respectively. The apparatus includes an entrance exhaust stack extending from the green-end and an exit exhaust stack extending from the dry-end. The apparatus also includes first inlet and outlet pressure differential transmitters positioned at the respective inlet and outlet seal sections for sensing a difference in pressure between the seal sections and the respective drying zones, and second inlet and outlet pressure differential transmitters positioned at the respective green-end and dry-end for sensing a difference in pressure between the respective drying zones and the outside atmosphere. The apparatus further includes a controller communicatively connecting the pressure differential transmitters to an exhaust damper at each of the entrance and exit exhaust stacks for controlling the exhaust flow rates at each of the exhaust stacks.

One aspect of the invention provides a method for drying materials. The materials to be dried may be wood veneer. The method involves the steps of introducing a material into a dryer chamber; maintaining the chamber at a temperature sufficient to vaporize water in the material into steam; conveying the material along a length of the chamber from an inlet end to a dry-end exit end to condition the material using the steam created from vaporizing the material; controlling a migration of moisture between the inlet and dry-end exit ends by exhausting steam near the inlet end of the chamber and exhausting steam near the outlet end of the chamber; and withdrawing the material from the chamber. In some embodiments, the steam is exhausted at a green-end near the inlet end and at a dry-end near the dry-end exit end.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Figure 1:
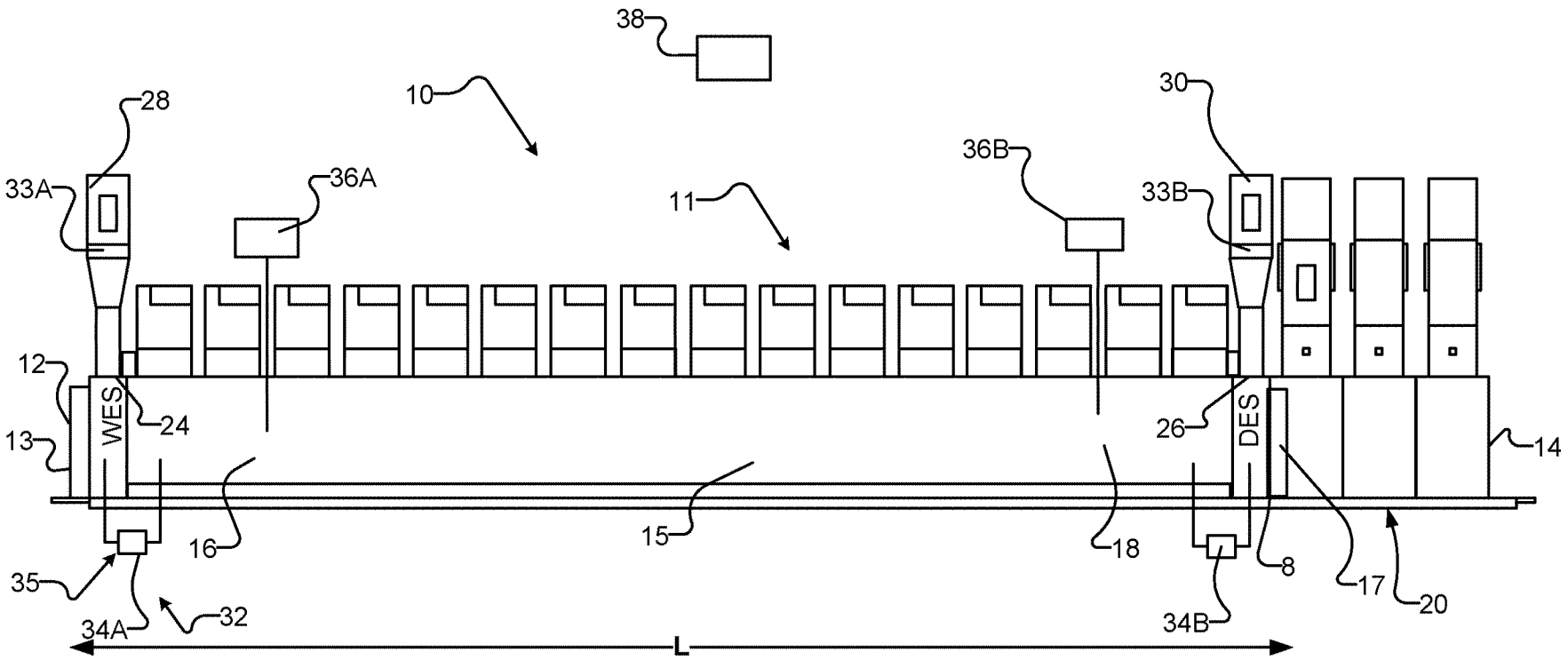
FIG. 1 is a schematic diagram showing a dryer according to an example embodiment.
Figure 2:
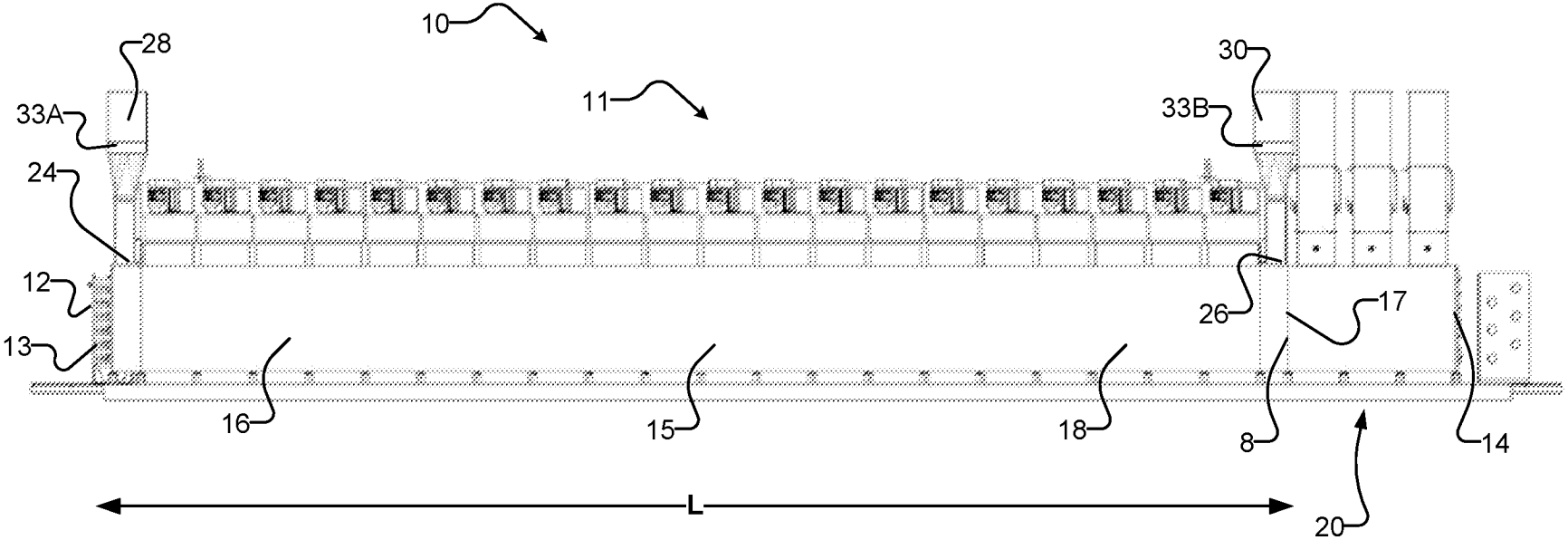
FIG. 2 is a front elevation view showing the FIG. 1 dryer.
Figure 3:
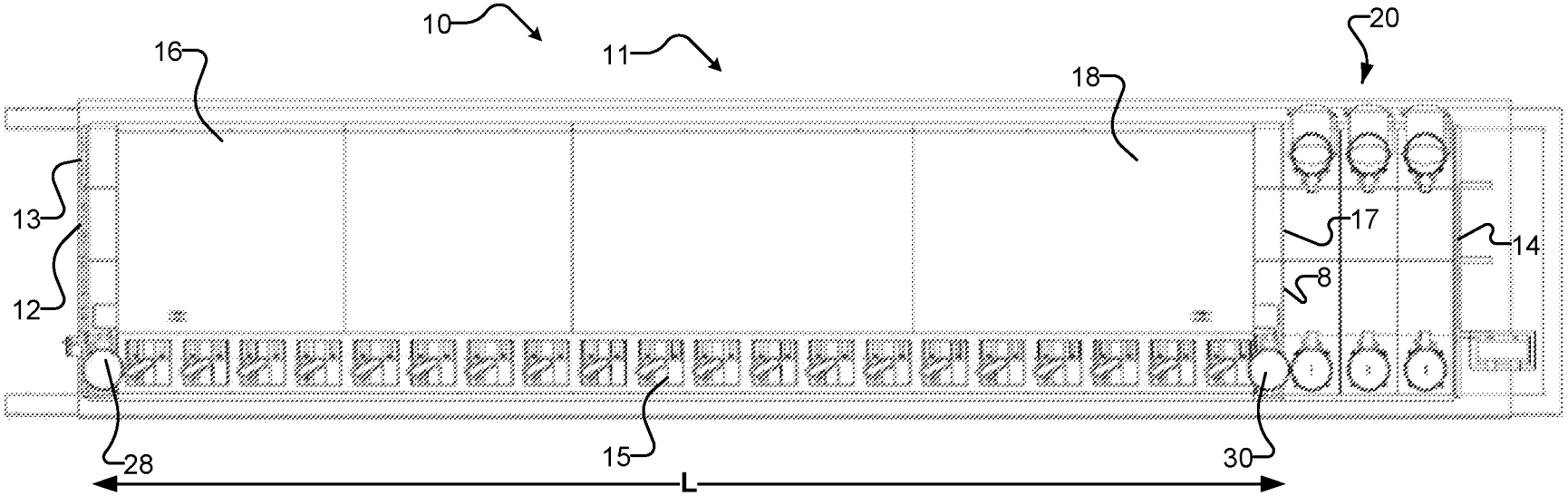
FIG. 3 is a top plan view showing the FIG. 1 dryer.
Figure 4:
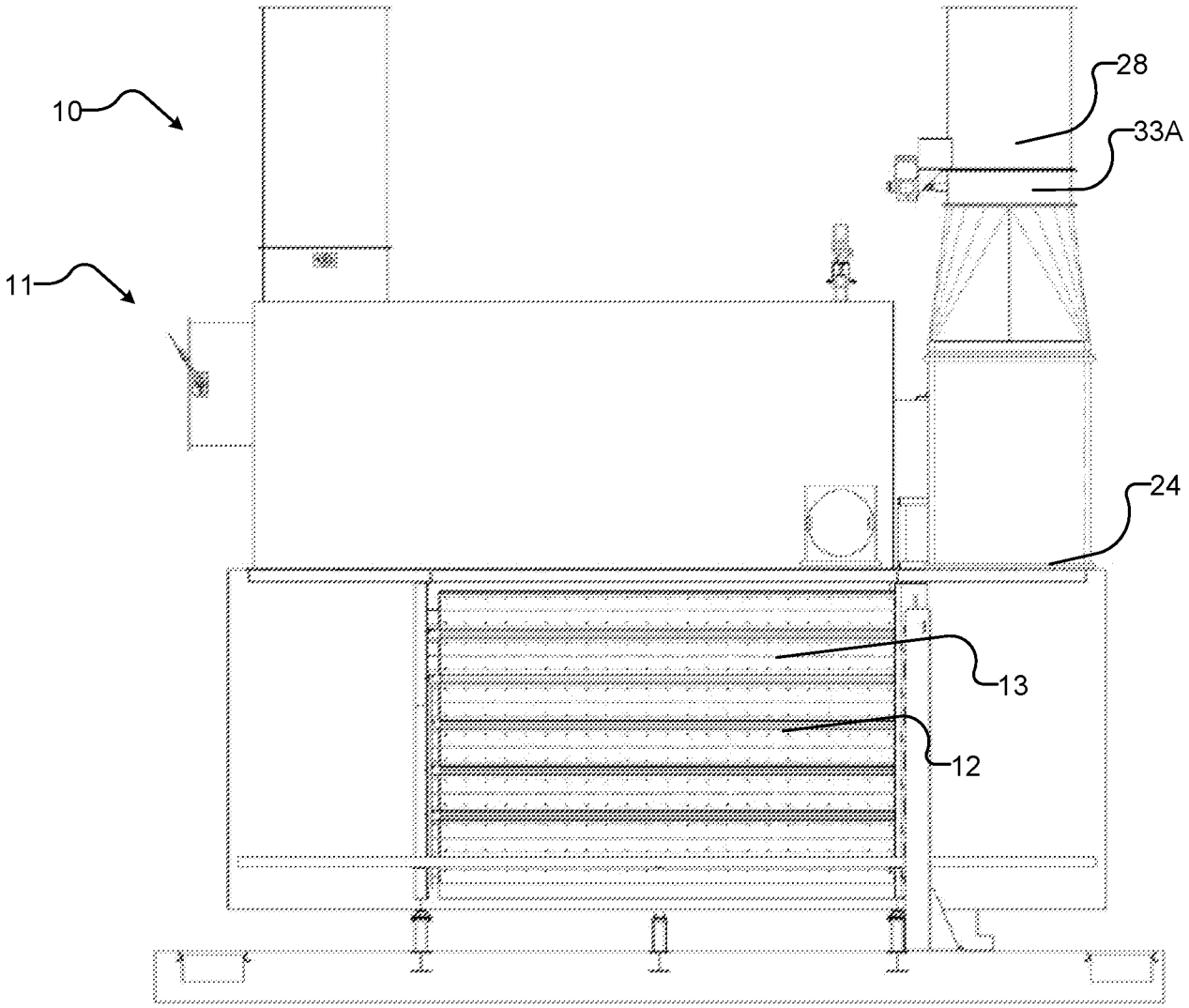
FIG. 4 is side elevation view showing the FIG. 1 dryer.
Figure 5:
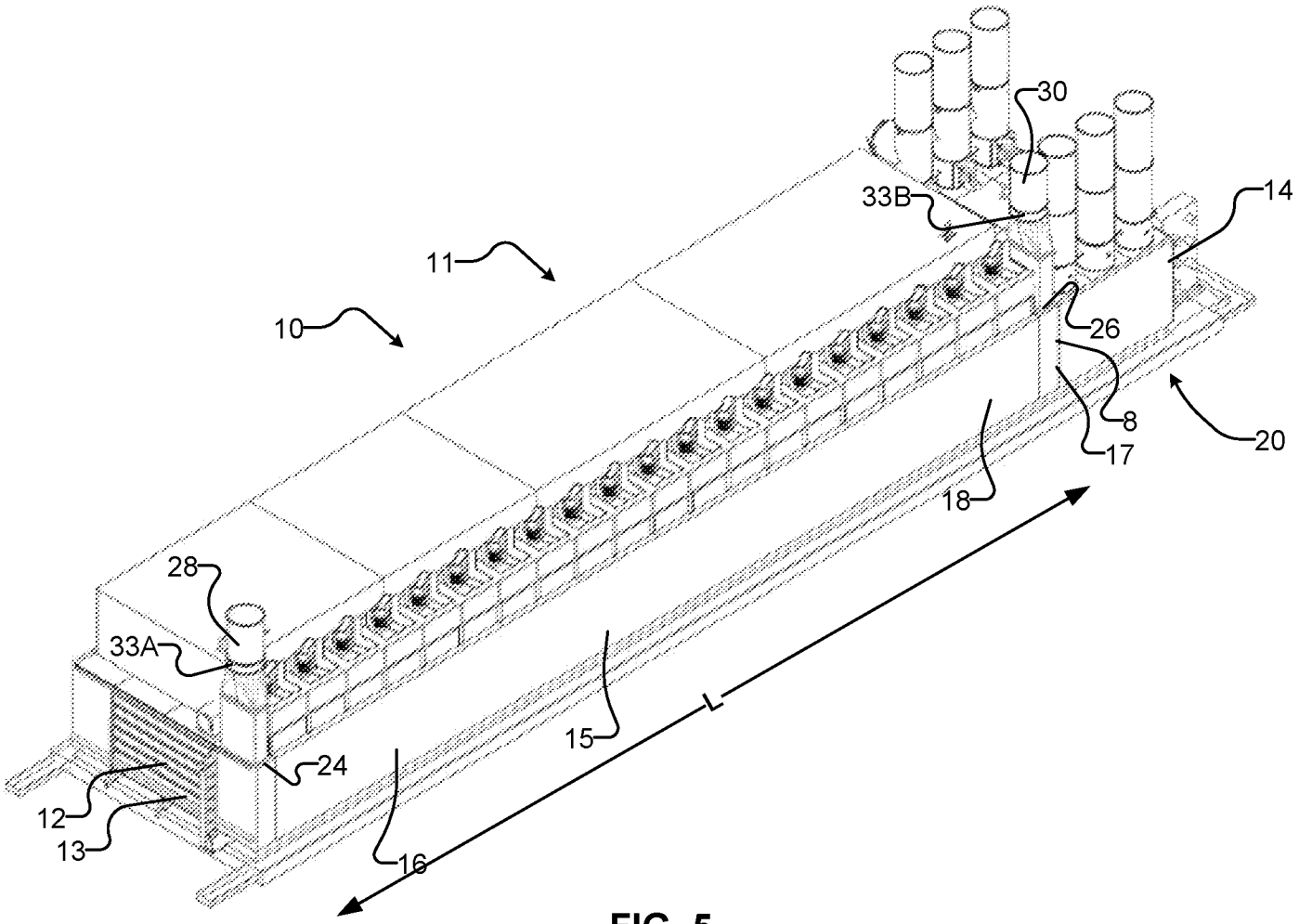
FIG. 5 is an upper perspective view showing the FIG. 1 dryer.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

An aspect of the invention relates to an apparatus for drying materials (also referred to as a dryer). The dryer has a chamber which is heated to a temperature sufficient to vaporize the free and bound water in the material into steam. The dryer may be configured to utilize the steam produced from the undried or wet material to condition the material. The dryer has two exhaust stacks positioned at opposing ends of the dryer. The exhaust stacks are configured to exhaust gas from opposing ends of the dryer. The removal of exhaust steam at the two opposing ends of the chamber facilitates the migration of moisture within the chamber along a length thereof. The exhaust flow rate at each of the exhaust stacks may be controlled and adjusted based on feedback from one or more sensors. The one or more sensors include differential pressure transmitters. A plurality of differential pressure transmitters may be installed at multiple positions within the chamber for monitoring the pressure at multiple positions along the chamber over the course of the drying process.

FIGS. 1-5 illustrate a dryer 10 according to an example embodiment. In the example embodiment, dryer 10 includes a chamber 11 within a housing 15. Chamber 11 may extend along a length (L) thereof between an inlet end 12 and a dry-end exit end 8. Chamber 11 may be divided into a plurality of drying zones. Chamber 11 may comprise a green-end 16 near inlet end 12 and a dry-end 18 near dry-end exit end 8. In the illustrated embodiments, an inlet end seal section 13 is connected to inlet end 12. An outlet end seal section 17 may be connected to dry-end exit end 8. In some embodiments a negative pressure is created within each of seal sections 13, 17. Seal sections 13, 17 may be provided to prevent steam and/or moisture from escaping housing 15.

The green or undried materials may be introduced into inlet end 12 of seal section 13 and moved into green-end 16. The materials may pass longitudinally through the length (L) of chamber 11 from green-end 16 to dry-end 18. The materials may exit chamber 11 from dry-end exit end 8. The materials may then pass through one or more cooling sections 20 before exiting dryer 10 from outlet end 14. In some embodiments dryer 10 does not include cooling sections 20. In such embodiments materials exit chamber 11 from dry-end exit end 8.

Chamber 11 may be maintained at a temperature sufficient to vaporize the water in the material to be dried into steam. In some embodiments steam or gas is used as the heating medium inside chamber 11. Other heating medium may be used in chamber 11. Non-limiting examples of heating medium include thermal oil, and waste wood.

The plurality of zones within chamber 11 may be maintained at different temperatures. Green-end 16 may be maintained at a temperature higher than at dry-end 18. The temperature within chamber 11 may be in a range of between about 350° F. and about 550° F. In some embodiments the temperature within chamber 11 is less than 350° F. In some embodiments the temperature within chamber 11 is greater than 550° F. In some embodiments the steam produced from the wet material is used in drying or conditioning the material itself. In such embodiments external air is not introduced during the drying process.

In some embodiments improved humidity control within chamber 11 is provided by exhausting gas (or removing steam) from opposing ends of chamber 11, i.e., from green-end 16 and dry-end 18.

An entrance hood 24 may be provided over the area where the wet material enters green-end 16. An exit hood 26 may be provided over where dried materials exit from dry-end 18 into one or more cooling sections 20. Entrance hood 24 may include an entrance exhaust stack 28. Entrance exhaust stack 28 may extend upwardly from entrance hood 24. Exit hood 26 may include an exit exhaust stack 30. Exit exhaust stack 30 may extend upwardly from exit hood 26.

Exhaust stacks 28, 30 are configured to exhaust steam from within chamber 11 out into the atmosphere. Entrance exhaust stack 28 may be configured to exhaust steam produced from green-end 16. Green-end 16 typically has high humidity levels. This is due to the high moisture content of the wet material that is fed into chamber 11 at inlet end 12. For example, in the case of drying wood veneers, the high moisture content at green-end 16 results from the evaporation of the free water in wood veneers. In particular, once the moisture-laden wood veneer enters the hot drying chamber 11, the free water rapidly evaporates into steam creating the high humidity environment within green-end 16.

In some embodiments entrance exhaust stack 28 exhausts excess steam from green-end 16. "Excess steam" is the steam remaining in the green-end 16 after the material has passed such zone. In other words, the amount of "excess steam" is the difference between the amount of steam generated from the material (i.e., from vaporizing the water in the material) and the amount of steam used to dry or condition the material in the green-end 16. Removal of excess steam from the green-end 16 prevents the steam from exiting dryer 10 via inlet end 12 or in some circumstances through leaks and gaps in housing 15. In some embodiments the steam exhausted from green-end 16 includes steam generated at inlet end seal section 13.

Exit exhaust stack 30 may be configured to exhaust steam from dry-end 18. The removal of steam from exit exhaust stack 30 facilitates a flow of moisture downstream of chamber 11 from green-end 16 towards dry-end 18. The increase in exhaust flow rate at the dry-end 18 creates a pressure lower than that from the remainder of chamber 11, particularly compared to the pressure level at green-end 16. This induces air to flow from green-end 16 to dry-end 18. The flow of air carries moisture with it. This facilitates the distribution of moisture within the length of chamber 11.

The exhaust air flow at exhaust stacks 28, 30 may be adjusted over the course of the drying process, for example, as the wet materials are conveyed along the length of chamber 11. In some embodiments, the humidity within chamber 11 is controlled by controlling the exhaust air flow within exhaust stacks 28, 30. In some embodiments, the exhaust flow rate at exhaust stacks 28, 30 changes over the course of the drying process. The exhaust flow rate at exhaust stack 28 may be the same or different from the exhaust flow rate at exhaust stack 30 at a given time during the process.

In some embodiments, dampers 33A, 33B within exhaust stacks 28, 30 are communicatively connected to one or more sensors 32. The exhaust air flow at exhaust stacks 28, 30 may be adjusted based on feedback transmitted from one or more sensors 32. Sensors 32 may be configured to communicate with dampers 33A, 33B within exhaust stacks 28, 30 in real time over the course of the drying process. Dampers 33A, 33B regulate the flow of air inside the respective exhaust stacks 28, 30. The humidity level within chamber 11 may in turn be controlled. In some embodiments, the humidity level within chamber 11 is not adjusted by drawing ambient air into chamber 11.

In some embodiments, sensors 32 include one or more differential pressure transmitters 35. In some embodiments, a plurality of differential pressure transmitters 35 is located at different positions within chamber 11 along the length thereof. In the illustrated embodiments, a first and a second inlet differential pressure transmitter 34A, 36A are positioned near inlet end 12, and a first and a second outlet differential pressure transmitter 34B, 36B are positioned near dry-end exit end 8.

First differential pressure transmitters 34A, 34B may be configured to monitor the difference in pressure levels between the respective seal sections 13, 17 and chamber 11. Specifically, first inlet differential pressure transmitter 34A may be configured to monitor the differential pressure between seal section 13 and green-end 16. First outlet differential pressure transmitter 34B may be configured to monitor the differential pressure between seal section 17 and dry-end 18.

Second differential pressure transmitters 36A, 36B may be positioned at green-end 16 and dry-end 18 respectively. Second inlet differential pressure transmitter 36A may be configured to measure the differential pressure between green-end 16 and an outside atmosphere, such as for example, the ambient pressure in the mill. Second outlet differential pressure transmitter 36B may be configured to measure the differential pressure between dry-end 18 and the outside atmosphere.

Differential pressure transmitters 34A, 34B, 36A, 36B may be communicatively connected to controller 38. Controller 38 may be configured to receive one or more input data from differential pressure transmitters 34A, 34B, 36A, 36B. Controller 38 may compare the one or more input data to process set points. The one or more input data may be the differential pressure detected at each of the transmitters at a given point in time during the drying process. Process set points may be the desired differential pressure detected at each of the transmitters. The desired differential pressure levels may be the differential pressure at each transmitter which would facilitate the migration of moisture downstream from green-end 16 to dry-end 18. In some embodiments, the desired pressure level may be the differential pressure at each transmitter which would also facilitate the prevention of steam from egressing out of chamber 11 via inlet end 12.

In response to the input data (e.g., if controller 38 determines that there is a difference between input data and process set points), controller 38 may transmit output control data to one or both dampers 33A, 33B for regulating the flow of air inside the respective exhaust stacks 28, 30. Output control data may for example be the calculated amount of increase or decrease in exhaust flow rate at each of damper 33A, 33B.

In one example operation, controller 38 receives from differential pressure transmitters 34A, 34B, 36A, 36B input data indicative that the pressure at green-end 16 is lower than that at dry-end 18, and that the pressure at the dry-end 18 is higher than an atmospheric pressure, controller 38 may send an actuation signal to open damper 33B. Opening damper 33B increases the exhaust flow rate at exit exhaust stack 30. This in turn lowers the pressure at dry-end 18 which results in increasing a flow of steam downstream of chamber 11.

An exhaust flow meter may be positioned in each of entrance and exit exhaust stacks 28, 30. Exhaust flow meters may be configured to measure the flow rate of exhaust gas leaving chamber 11 at each end thereof.

In some embodiments the total exhaust flow rate from exhaust stacks 28, 30 is set to maintain at dry-end 18 a pressure lower than the pressure at green-end 16 at all times during the drying process.

In some embodiments, the total exhaust flow rate from exhaust stacks 28, 30 is set to maintain the overall pressure within chamber 11 to be higher than the ambient pressure in the mill.

In some embodiments a plurality of pressure sensors and humidity sensors are provided at various positions along the length (L) of chamber 11 during installation and calibration of dryer 10. The pressure sensors may be used to monitor the pressure changes and the humidity sensors may be used to monitor the migration of moisture along the length (L) of chamber 11.

An aspect of the invention relates to a method of drying materials. The method involves exhausting steam from two opposing ends of a drying chamber. This facilitates the movement of moisture along the length of the drying chamber, specifically from the inlet end which has high humidity content downstream to the outlet end which has low humidity content. The ability to move moisture along the length of the drying chamber has at least the following advantages: reduced energy consumption; reduced pitch build-up; reduced fire risk; improved quality of the material; and improved drying, e.g., the material is neither over-dried nor under-dried. In some embodiments the method involves drying materials using dryer 10.

Figure 6:
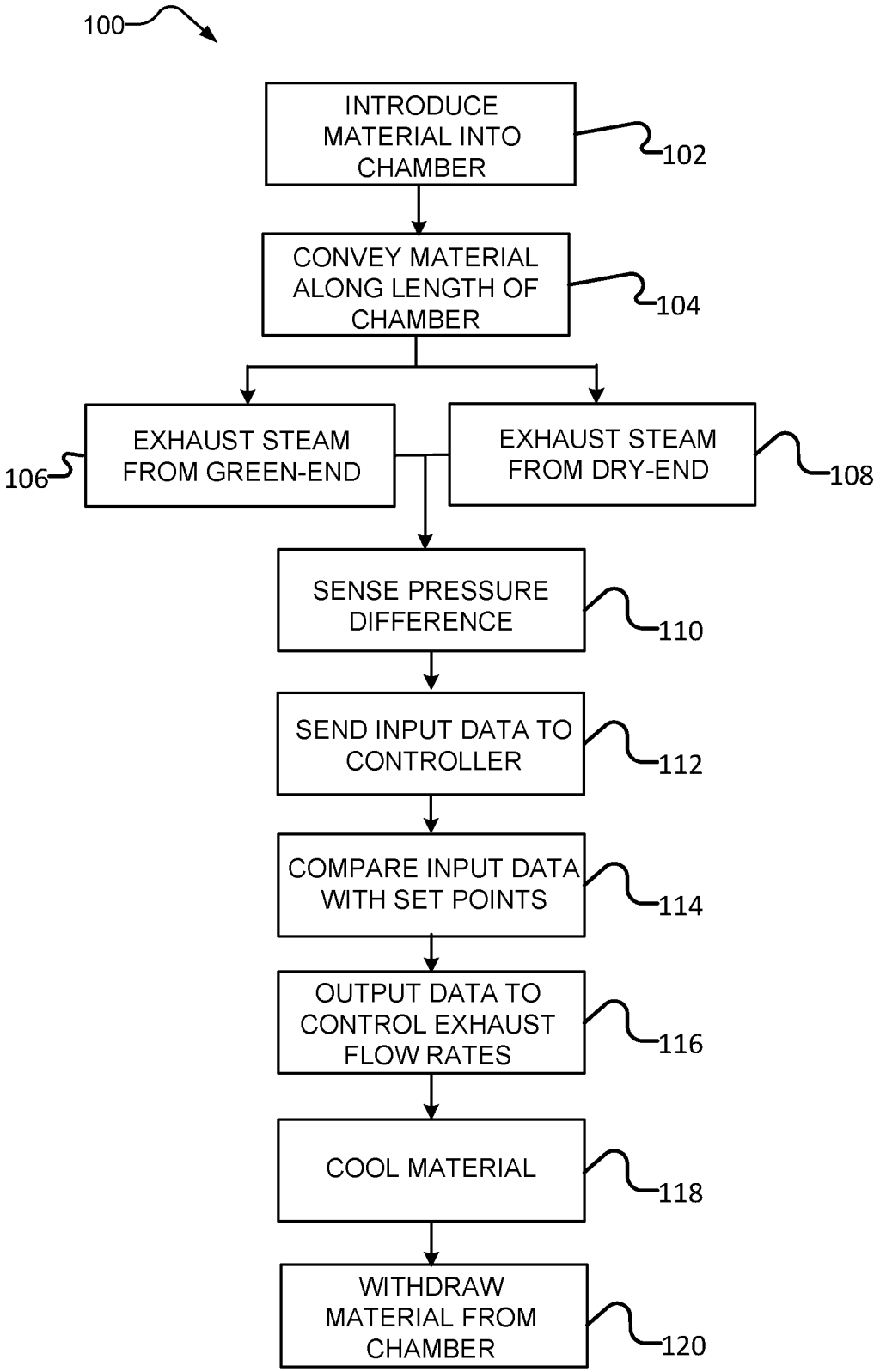
FIG. 6 is a flow chart illustrating a method of drying materials according to an example embodiment.

FIG. 6 is a flow chart illustrating a method 100 of drying materials according to an example embodiment. Method 100 involves introducing the materials to be dried into a drying chamber at an inlet end (step 102). In some embodiments steam is used as the heating medium within the drying chamber. In such embodiments the chamber may be maintained at a temperature sufficient to vaporize the water in the material into steam. Other heating medium such as thermal oil, waste wood, and the like may also be used as the heating medium.

The materials to be dried may be conveyed along a length of the drying chamber from the inlet end to a dry-end exit end (step 104). Method 100 involves exhausting steam from a green-end near the inlet end of the chamber (step 106). Method 100 also involves exhausting steam from a dry-end near the dry-end exit end of the chamber (step 108). Exhausting steam from the green-end (step 106) may be performed at the same time or at a different time from exhausting steam from the dry-end (step 108). Step 110 comprises sensing using a first inlet differential pressure transmitter a pressure difference between an inlet end seal section and the green-end. Step 110 may also comprise sensing using a first outlet differential pressure transmitter a pressure difference between an outlet end seal section and the dry-end. Step 110 may additionally comprise sensing using a second inlet differential pressure transmitter a pressure difference between the green-end and the outside atmosphere. Step 110 may further comprise sensing using a second outlet differential pressure transmitter a pressure difference between the dry-end and the outside atmosphere. The input data received from the first and second pressure transmitters are transmitted to a controller for comparison with process set points (step 114). The controller transmits output data to the respective exhaust dampers to control and adjust the exhaust flow rates at the exhaust stacks (step 116). The dried materials exit the dryer at the outlet end (step 120). Optionally, the dried materials are conveyed to one or more cooling sections for cooling prior to exiting the dryer (step 118).

INTERPRETATION OF TERMS

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof; elements which are integrally formed may be considered to be connected or coupled;
- "herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

While a number of exemplary aspects and embodiments are discussed herein, those of skill in the art will recognize certain modifications, permutations, additions and sub-combinations thereof.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A method for drying materials comprising:

introducing a material into a dryer chamber;

creating steam from vaporizing moisture in the material by maintaining the chamber at a temperature;

conditioning the material using the steam created from vaporing moisture in the material by conveying the material along a length of the chamber from an inlet end to an outlet end;

exhausting steam near the inlet end of the chamber;

exhausting steam near a dry-end exit end of the chamber;

controlling a migration of moisture between the inlet and outlet ends by adjusting an exhaust flow rate near the inlet end of the chamber and/or an exhaust flow rate near the dry-end exit end of the chamber; and withdrawing the material from the chamber.

2. The method as defined in claim 1 wherein the steam is exhausted at a green-end near the inlet end and at a dry-end near the dry-end exit end.

3. The method as defined in claim 2 wherein the controlling of the migration of moisture comprises producing a pressure at the dry-end which is lower than a pressure at the green-end.

4. The method as defined in claim 3 wherein the lower pressure at the dry-end than the green-end is produced by increasing an exhaust flow rate at the dry-end.

5. The method as defined in claim 4 comprising adjusting the exhaust flow rate at the dry-end to be higher than an exit exhaust flow rate at the green-end.

6. The method as defined in claim 5 further comprising maintaining a pressure at the dry-end which is lower than a pressure at the green-end.

7. The method as defined in claim 1 further comprising maintaining an overall pressure within the chamber to be higher than a pressure at an outside atmosphere.

8. The method as defined in claim 7 wherein the pressure at the outside atmosphere is an ambient pressure in a mill.

9. The method as defined in claim 7 wherein maintaining the overall pressure comprises adjusting one or both of an entrance exhaust flow rate and the exit exhaust flow rate at a respective one of the green-end and the dry-end.

10. The method as defined in claim 9 wherein the adjusting of one or both of the exhaust flow rates comprises monitoring first inlet and outlet differential pressures and second inlet and outlet differential pressures at the green-end and the dry-end.

11. The method as defined in claim 10 wherein the monitoring of first inlet and outlet differential pressures comprises detecting a pressure difference between an inlet end and an outlet end seal section and a respective one of the green-end and the dry-end.

12. The method as defined in claim 11 wherein the monitoring of second inlet and outlet differential pressures comprises detecting a pressure difference between the outside atmosphere and a respective one of the green-end and the dry-end.

13. The method as defined in claim 1 wherein the temperature within the chamber is in a range of between 350° F. and 550° F. within the chamber.

14. The method as defined in claim 1 wherein the temperature within the chamber is less than 350° F. within the chamber.

15. The method as defined in claim 1 wherein the temperature within the chamber is greater than 550° F. within the chamber.

16. The method as defined in claim 2 wherein the temperature within the green-end is higher than the temperature within the dry-end.

* * * * *